US011694708B2

(12) United States Patent
McNeill et al.

(10) Patent No.: US 11,694,708 B2
(45) **Date of Patent: *Jul. 4, 2023**

(54) AUDIO DEVICE AND METHOD OF AUDIO PROCESSING WITH IMPROVED TALKER DISCRIMINATION

(71) Applicant: Plantronics, Inc., Santa Cruz, CA (US)

(72) Inventors: Iain McNeill, Aptos, CA (US); Matthew Nunes Neves, Freedom, CA (US); Gavin Radolan, Merritt Island, FL (US)

(73) Assignee: Plantronics, Inc., Santa Cruz, CA (US)

( * ) Notice: Subject to any disclaimer, the term of this patent is extended or adjusted under 35 U.S.C. 154(b) by 65 days.

This patent is subject to a terminal disclaimer.

(21) Appl. No.: 17/163,713

(22) Filed: Feb. 1, 2021

(65) Prior Publication Data

US 2021/0151066 A1 May 20, 2021

Related U.S. Application Data

(63) Continuation-in-part of application No. 16/570,924, filed on Sep. 13, 2019, now Pat. No. 11,264,014.
(Continued)

(51) Int. Cl.
*G10L 21/0308* (2013.01)
*G10L 25/06* (2013.01)
(Continued)

(52) U.S. Cl.
CPC ..... *G10L 21/0308* (2013.01); *G10L 25/06* (2013.01); *G10L 25/18* (2013.01);
(Continued)

(58) Field of Classification Search
CPC .. H04R 1/1083; H04R 3/005; H04R 2410/05; H04R 1/1008; H04R 1/406;
(Continued)

(56) References Cited

U.S. PATENT DOCUMENTS 5,485,524 A * 1/1996 Kuusama ..... H03G 9/025 704/226
7,039,179 B1 5/2006 Gerhardt et al.
(Continued)

OTHER PUBLICATIONS

Leo L. Beranek, "Acoustics" 1993 Edition, 25 pages, 1954.
(Continued)

*Primary Examiner* — Mohammad K Islam
(74) *Attorney, Agent, or Firm* — Quarles & Brady LLP

(57) ABSTRACT

An audio device for improved talker discrimination is provided. To improve suppression of close talker interference, the audio device comprises at least a first and a second audio input to receive a first and second voice input signal; a first filter bank, configured to provide a plurality of first sub-band signals; a second filter bank, configured to provide a plurality of second sub-band signals; a correlator, configured to determine at least one signal correlation between at least a group of the first sub-band signals and at least a group of the second sub-band signals; and an attenuator, arranged to receive at least the group of the first sub-band signals and configured to conduct signal attenuation on the group of the first sub-band signals to provide gain-controlled sub-band signals, wherein the signal attenuation is based on the determined at least one signal correlation.

19 Claims, 6 Drawing Sheets

Related U.S. Application Data

(60) Provisional application No. 62/735,160, filed on Sep. 23, 2018.

(51) Int. Cl.

| | |
|---|---|
| ***G10L 25/21*** | (2013.01) |
| ***G10L 25/18*** | (2013.01) |
| ***H04R 1/40*** | (2006.01) |
| ***H04R 1/10*** | (2006.01) |
| ***H04R 3/00*** | (2006.01) |
| ***G10L 25/78*** | (2013.01) |

(52) U.S. Cl.
CPC ..... *G10L 25/21* (2013.01); *G10L 25/78* (2013.01); *H04R 1/1008* (2013.01); *H04R 1/406* (2013.01); *H04R 3/005* (2013.01); *H04R 2410/01* (2013.01)

(58) Field of Classification Search
CPC ..... H04R 2410/01; G10K 11/178; G10K 2210/3028; G10K 11/175; G10K 2210/3011; G10K 2210/30231; G10L 25/06; G10L 21/0308; G10L 25/18; G10L 25/21; G10L 25/78
See application file for complete search history.

(56) References Cited

U.S. PATENT DOCUMENTS

| | | | | |
|---|---|---|---|---|
| 7,197,456 | B2 * | 3/2007 | Haverinen | G10L 15/20 704/226 |
| 7,376,558 | B2 | 5/2008 | Gemello et al. | |
| 8,213,598 | B2 * | 7/2012 | Bendersky | H04B 3/23 379/406.13 |
| 8,271,279 | B2 * | 9/2012 | Hetherington | G10L 21/0216 704/211 |
| 8,750,491 | B2 * | 6/2014 | Prakash | H04M 9/082 379/406.05 |
| 8,798,992 | B2 * | 8/2014 | Gay | G10L 21/028 704/226 |
| 8,914,282 | B2 * | 12/2014 | Konchitsky | G10L 21/0208 704/226 |
| 9,043,203 | B2 * | 5/2015 | Rettelbach | G10L 19/0204 704/226 |
| 9,088,328 | B2 * | 7/2015 | Gunzelmann | H04B 1/1036 |
| 9,202,463 | B2 * | 12/2015 | Newman | G10L 25/78 |
| 9,613,612 | B2 * | 4/2017 | Perkmann | G10K 11/17861 |
| 9,711,130 | B2 | 7/2017 | Hendrix et al. | |
| 9,792,897 | B1 * | 10/2017 | Kaskari | G10L 15/20 |
| 9,959,886 | B2 * | 5/2018 | Anhari | G10L 25/78 |
| 10,192,567 | B1 * | 1/2019 | Kamdar | G10L 25/84 |
| 10,339,949 | B1 | 7/2019 | Dusan | |
| 10,355,658 | B1 | 7/2019 | Yang | |
| 2009/0265169 | A1 * | 10/2009 | Dyba | G10L 19/012 704/E15.001 |
| 2009/0287489 | A1 | 11/2009 | Savant | |
| 2013/0332175 | A1 * | 12/2013 | Setiawan | G10L 19/012 704/500 |
| 2014/0126733 | A1 | 5/2014 | Gauger et al. | |
| 2014/0162731 | A1 | 6/2014 | Helsloot et al. | |
| 2014/0214676 | A1 * | 7/2014 | Bukai | G10L 17/24 705/44 |
| 2015/0302845 | A1 * | 10/2015 | Nakano | G10L 25/15 704/267 |
| 2016/0077794 | A1 | 3/2016 | Kim et al. | |
| 2017/0200444 | A1 | 7/2017 | O'Connell et al. | |
| 2017/0374478 | A1 * | 12/2017 | Jones | G10L 21/0364 |
| 2018/0190307 | A1 | 7/2018 | Hetherington et al. | |
| 2018/0357995 | A1 * | 12/2018 | Lee | G10K 11/178 |
| 2019/0108837 | A1 * | 4/2019 | Christoph | G06F 3/165 |
| 2019/0115040 | A1 | 4/2019 | Kamdar et al. | |
| 2019/0222943 | A1 * | 7/2019 | Andersen | H04R 25/507 |
| 2019/0259381 | A1 * | 8/2019 | Ebenezer | H04R 3/005 |
| 2020/0058320 | A1 * | 2/2020 | Liu | G10L 15/22 |
| 2020/0243061 | A1 * | 7/2020 | Sun | G10K 11/17854 |
| 2022/0246161 | A1 * | 8/2022 | Verbeke | H03F 3/183 |

OTHER PUBLICATIONS

Equivalent Rectangular Bandwidth, https://ccrma.stanford.edu/~jos/bbt/Equivalent_Rectangular_Bandwidth.html, 4 pages, Oct. 29, 2020.
Coherence (signal processing, https://en.wikipedia.org/wiki/Coherence_(signal_processing), 2 pages, Oct. 29, 2020.
"Dual Microphone Adaptive Noise reduction Software," *VOCAL*, White Paper, 8 pages, Dec. 15, 2015.
Gustafsson et al.; "Dual-Microphone Spectral Subtraction" University of Kaklskrona/Ronneby, 37 pages, 2000.
Jeub et al., "Noise Rediuction for Dual-Micrphone Mobile Phones Exploiting Power Level Differences" Institute of Communication Systems and Data Processing, 4 pages, 2012.
Ray Chien, A Coherence-Based Algorithm for Noise Reduction in Dual-Microphone Applications, TONIC Lab, 18 pages, Oct. 29, 2020.
Hugo Fastl et al., "Psychoacoustics Facts and Models" Chapter 8, 22 pages, Aug. 2006.
Hugo Fastl et al., "Psychoacoustics Facts and Models" Chapter 6, 16 pages, Aug. 2006.
Hugo Fastl et al., "Psychoacoustics Facts and Models" Chapter 5, 23 pages, Aug. 2006.
Hugo Fastl et al., "Psychoacoustics Facts and Models" Chapter 4, 28 pages, Aug. 2006.
Hugo Fastl et al., "Psychoacoustics Facts and Models" Chapter 3, 22 pages, Aug. 2006.

* cited by examiner

AUDIO DEVICE AND METHOD OF AUDIO PROCESSING WITH IMPROVED TALKER DISCRIMINATION

CROSS REFERENCE TO RELATED APPLICATIONS

This application is a continuation-in-part (CIP) of U.S. Non-provisional patent application Ser. No. 16/570,924, filed on Sep. 13, 2019 with the United States Patent and Trademark Office. U.S. patent application Ser. No. 16/570,924 claims priority to U.S. Provisional Patent Application No. 62/735,160, filed on Sep. 23, 2018 with the United States Patent and Trademark Office. The contents of the aforesaid applications are hereby incorporated by reference in their entireties.

FIELD OF INVENTION

This invention relates to audio devices and digital audio processing methods, such used in telecommunications applications.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

A problem exists when an audio device, such as a mobile phone or headset, is used in a noisy environment. In these scenarios, it may be difficult for the microphone of the audio device to capture the voice of the device user sufficiently, while keeping the picked up noise at a minimum for increased speech clarity. Particularly problematic are situations, where another person is talking close by. A typical scenario where other persons are talking close by is in a call center environment. While call center workers may use headsets to bring the microphone close to the respective user's mouth, even typical headset microphones may not be able to sufficiently discriminate between the user, i.e., the headset wearer, and another person talking in close proximity. In addition, in some environments, even a highly directional microphone may be unable to distinguish between the actual headset wearer and another talker who is located on-axis, but further away. This problem is referred to as "close talker interference."

Prior art solutions utilize a noise gate (center clipper) that attenuates all mic signals below a certain threshold. While this can be tuned to effectively cut out background noises of all kinds in the silence between the user's utterances, it may produce a pumping or surging effect when the user starts talking. If the microphone is not optimally positioned close to the user's mouth, then the noise gate can even cut off initial and/or trailing speech components which degrades intelligibility and efficiency.

Historically, directional microphones have been used to reduce ambient noise pickup, but these are only effective in the directions of their nulls, e.g., to the sides with bidirectional microphones and away from the mouth with cardioid mics. They do little to eliminate interfering speech coming close to the microphone pick up axis.

SUMMARY

Accordingly, an object is given to provide an audio device and a method of audio processing with improved talker discrimination, in particular for close talker interference.

In general and in one exemplary aspect, an audio device with improved talker discrimination is provided. The audio device of this aspect comprises at least a first audio input to receive a first voice input signal and a second audio input to receive a second voice input signal. A first filter bank is arranged to provide a plurality of first sub-band signals from the first voice input signal and a second filter bank is arranged to provide a plurality of second sub-band signals from the second voice input signal. The audio device further comprises a correlator, configured to determine at least one signal correlation between at least a group of the first sub-band signals and at least a group of the second sub-band signals; an attenuator, arranged to receive at least the group of first sub-band signals and configured to conduct signal attenuation on the group of first sub-band signals to provide gain-controlled sub-band signals, wherein the signal attenuation is based on the determined at least one signal correlation; and an audio output, configured to provide a voice output signal from at least the gain-controlled sub-band signals.

The details of one or more embodiments are set forth in the accompanying drawings and the description below. Other aspects, features, and advantages will be apparent from the description, drawings, and from the claims.

DESCRIPTION

Figure 1:
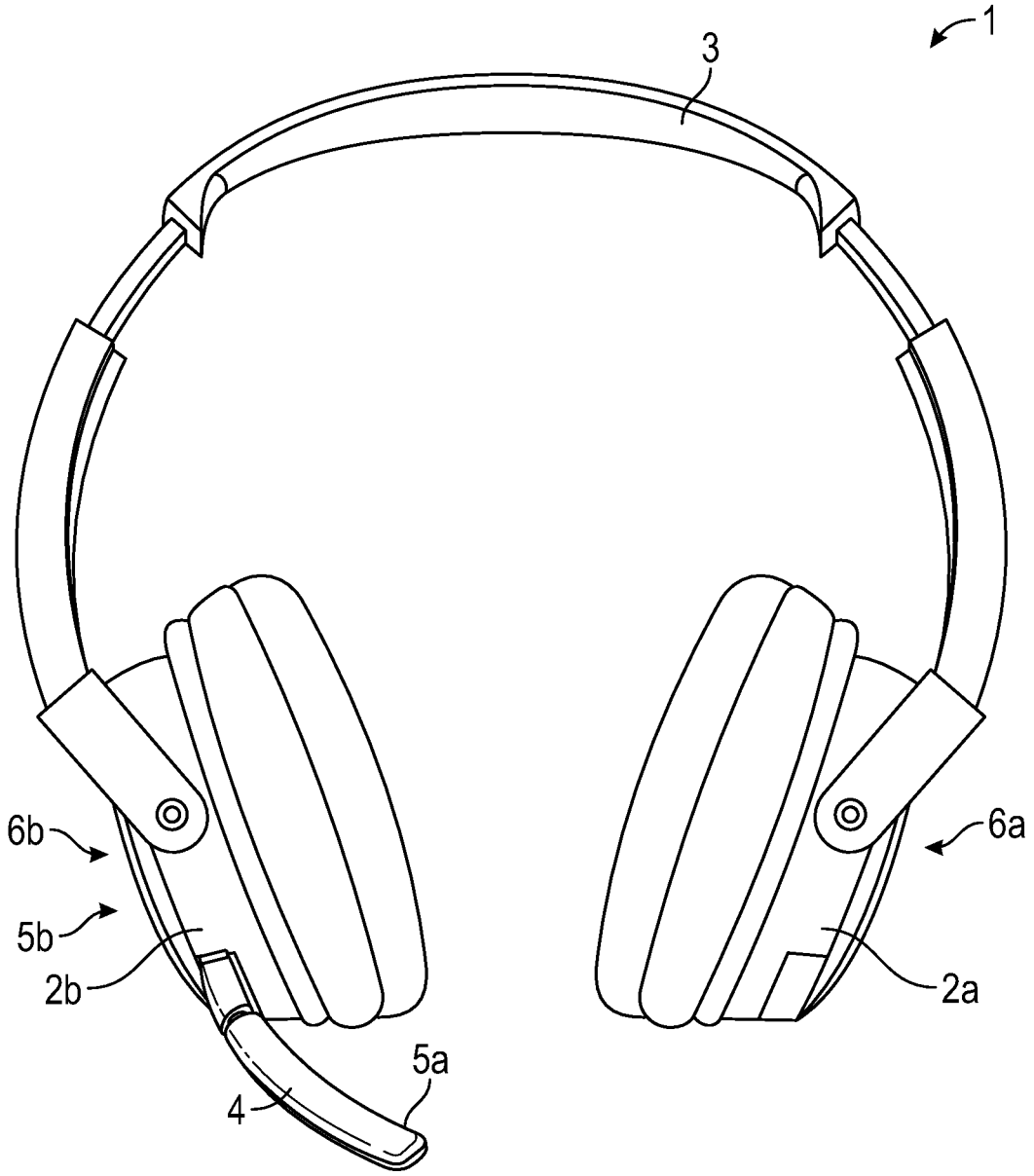
FIG. 1 shows an embodiment of an audio device with improved talker discrimination, namely of a headset.

Specific embodiments of the invention are here described in detail, below. In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following explanation of the present invention according to the embodiments described, the terms "connected to" or "connected with" are used to indicate a data and/or audio (signal) connection between at least two components, devices, units, processors, circuits, or modules. Such a connection may be direct between the respective components, devices, units, processors, circuits, or modules; or indirect, i.e., over intermediate components, devices, units, processors, circuits, or modules. The connection may be permanent or temporary; wireless or conductor based.

For example, a data and/or audio connection may be provided over a direct connection, a bus, or over a network connection, such as a WAN (wide area network), LAN (local area network), PAN (personal area network), BAN (body area network) comprising, e.g., the Internet, Ethernet networks, cellular networks, such as LTE, Bluetooth (classic, smart, or low energy) networks, DECT networks, ZigBee networks, and/or Wi-Fi networks using a corresponding suitable communications protocol. In some embodiments, a USB connection, a Bluetooth network connection, and/or a DECT connection is used to transmit audio and/or data.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

Discussed herein are devices and methods to address close talker interference using a signal correlation technique. As discussed in the preceding, when an audio device, such as a mobile phone or headset, is used in a noisy environment, it may be difficult for the microphone of the audio device to capture the voice of the device user sufficiently, while keeping the picked up noise at a minimum for increased speech clarity. Particularly problematic are situations, where another person is talking close by, referred to as "close talker interference" herein.

One basic idea of the above aspect is to improve suppression of close talker interference, i.e., of a person talking in close proximity to the user of the audio device, by determining a signal correlation between a first and a second voice input signal, such as obtained from a first and a second microphone, and to attenuate one of the voice input signals based on the determined signal correlation. The provided solution allows determination of close talker interference and efficient suppression of it.

In one exemplary aspect, an audio device with improved talker discrimination is provided. The audio device may be of any suitable type. In some embodiments, the audio device is a telecommunication audio device, e.g., a headset, a phone, a speakerphone, a mobile phone, a wearable device (body-worn audio device), a communication hub, or a computer, configured for telecommunication.

In the context of this application, the term "headset" refers to all types of headsets, headphones, and other head worn audio devices, such as for example circumaural and supra aural headphones, ear buds, in ear headphones, and other types of earphones. The headset may be of mono, stereo, or multichannel setup. The headset in some embodiments may comprise an audio processor. The audio processor may be of any suitable type to provide output audio from an input audio signal. The audio processor may, e.g., comprise hard-wired circuitry and/or programming for providing the described functionality. For example, the audio processor may be a digital signal processor (DSP).

The audio device of this aspect comprises at least a first audio input to receive a first voice input signal and a second audio input to receive a second voice input signal. The audio inputs may be of any suitable type for receiving the voice input signals, the latter of which may be audio signals that contains a user's voice or speech during use.

The terms "signal" and "audio signal" in the present context are used interchangeably and refer to an analogue or digital representation of audio in time or frequency domain. For example, the audio signals described herein may be of pulse code modulated (PCM) type, or any other type of bit stream signal. Each audio signal may comprise one channel (mono signal), two channels (stereo signal), or more than two channels (multichannel signal). The audio signal may be compressed or not compressed. The audio signal may be coded or uncoded.

In some embodiments, the audio inputs each comprise at least one microphone to capture the user's voice. The microphone may be of any suitable type, such as dynamic, condenser, electret, ribbon, carbon, piezoelectric, fiber optic, laser, or MEMS type. The microphone may be omnidirectional or directional. At least one microphone per audio input is arranged so that it captures the voice of the user, wearing the audio device.

It is noted that in the present context, the term 'microphone' is understood to include arrangements of multiple microphones, such as microphone arrays. The singular of the term 'microphone' is used herein to facilitate understanding, however, shall not be construed in a limiting manner. In case of multiple microphones, e.g. in a microphone array, a mixer may for example be used to obtain the respective voice input signal.

In some embodiments, the audio inputs each are connectable to at least one microphone to capture the user's voice.

In some embodiments, the first audio input comprises or is connectable to a first microphone and the second audio input comprises or is connectable to a second microphone. In some embodiments, the first and second microphones are arranged spaced apart from each other. For example, the first microphone may be arranged closer to the user's mouth during operation than the second microphone. In this example, the first microphone is considered to be the 'primary microphone' for capturing the user's voice, while the second microphone is considered to be the 'secondary microphone'. In some embodiments, the second microphone is oriented to capture ambient sound. For example, the second microphone may be omnidirectional to capture ambient sound.

In some embodiments, the first microphone is a directional microphone, for example having a hyper-cardioid directivity pattern.

The audio device according to the present exemplary aspect further comprises a first filter bank, configured to provide a plurality of first sub-band signals from the first voice input signal, and a second filter bank, configured to provide a plurality of second sub-band signals from the second voice input signal. In other words, each of the filter banks may 'split' the respective voice input signal into several frequency bands.

The audio device according to the present aspect further comprises a correlator, configured to determine at least one signal correlation between at least a group of the first sub-band signals and at least a group of the second sub-band signals; and an (audio) attenuator, arranged to receive the group of the first sub-band signals and configured to conduct signal attenuation on the received group of first sub-band signals to provide gain-controlled sub-band signals, wherein the signal attenuation is based on the determined at least one signal correlation.

The filter bank, the correlator, and the attenuator of the present aspect may be of any suitable type. In some embodiments, the aforesaid components are made of discrete electronic components. In some embodiments, the aforesaid components are integrated in one or more semiconductors. For example, the filter banks, the correlator, and/or the attenuator may be integrated into an audio processor, such as a DSP.

The filter banks may provide any number of sub-band signals. Generally, the number may be selected in dependence of the application. Some embodiments in this respect are discussed in the following in more detail.

As discussed in the preceding, the correlator is configured to determine the at least one signal correlation between the group of first sub-band signals and the group of the second sub-band signals. In the context of the present discussion, the term 'signal correlation' may be, e.g., understood as a measure of time-frequency correlation between the respective sub-band signals of first voice input signal and the second voice input signal. The term 'signal correlation' is used interchangeably herein with 'correlation', 'coherence' and 'signal coherence'.

In some embodiments, the determination of the at least one signal correlation comprises calculating a correlation function. In some embodiments, the at least one signal correlation corresponds to a spectral density correlation. A spectral density correlation may be calculated by analyzing the average power of the signals or sub-bands.

As discussed in the preceding, the attenuator of the present exemplary aspect is arranged to receive at least the group of the first sub-band signals and to conduct signal attenuation on at least this group based on the determined at least one signal correlation of the correlator. In other words, the conducted signal attenuation is dependent on the determined signal correlation.

The operation of the attenuator is based on the laws of acoustics, and in particular the inverse square law, which define the relative difference in amplitude between two voice signals, for example such as obtained by corresponding microphones. When only the user (e.g., a headset wearer) is talking, there generally is a strong signal correlation between the two signals. When there is another talker and/or noise, that correlation decreases. In case of the audio device being a headset or a body-worn audio device, the user maintains a fixed position of the two microphones relative to their mouth, which produces a well-defined amplitude relationship between the microphone signals. Conversely, interfering sounds other than the user's voice fall outside both of these relationships when assuming that the interfering sound emanates from a much larger distance, compared to the distance of the microphones to the user's mouth. Using these criteria, the user's voice can be identified and separated from interfering talkers and noise.

While in some embodiments, the correlator and/or the attenuator are configured to operate on each of the plurality of sub-band signals provided by the filter banks, in some alternative embodiments, the correlator and/or the attenuator are configured to operate on a smaller subset or group of the plurality of sub-band signals, i.e., not all of the respective plurality of sub-band signals as provided by the filter banks. For example, one or more of the lowest and highest bands of the audible frequency spectrum may not be subject to the processing of the correlator and/or the attenuator, since typically, no substantial close talker interference may be present in these sub-bands. Accordingly, in some embodiments, the respective one or more sub-band signals may be 'passed through from the filter bank to the audio output or an inverse Fast Fourier transform circuit (as discussed in more detail in the following) either directly or via intermediate components without processing by the correlator and/or the attenuator on these sub-bands. In some embodiments, the one or more sub-band signals that pass through without processing are subjected to spectral subtraction for noise reduction or to a different type of noise reduction for a further improved talker discrimination.

The audio device of the present exemplary aspect further comprises an audio output, configured to provide a voice output signal from at least the gain-controlled sub-band signals. The audio output may in some embodiments be configured to combine the gain-controlled sub-band signals and any pass-through sub-band signals, as discussed in the preceding, to obtain the voice output signal. The audio output may in some embodiments be configured to provide the voice output signal in a digital or analog format to a further component or device. For example, the audio output may comprise a wired or wireless communication interface to transmit the voice output signal to the further component or device.

The audio device in further embodiments may comprise additional components. For example, the audio device in some exemplary embodiments may comprise additional control circuitry, additional circuitry to process audio, a wireless communications interface, a central processing unit, one or more housings, and/or a battery.

In some embodiments, the processing by the filter bank, the correlator, and/or the attenuator is conducted in the frequency domain. In this case, e.g., the voice input signals may be processed using a Fast Fourier transform (FFT) by the filter banks or using separate components, i.e., one or more FFT circuits.

In some embodiments, an inverse FFT circuit is arranged in the signal path between the attenuator and the audio output to transform at least the gain-controlled sub-band signals and any pass-through sub-band signals back to the time domain and to thus to obtain a recombined time-domain signal. It is noted that the inverse FFT circuit may in some embodiments be arranged as part of the attenuator, the audio output and/or the sound processor. The FFT circuit and/or the inverse FFT circuit may be implemented using software executed on a processing device (e.g., a DSP), hard-wired logic circuitry, or a combination thereof.

In some embodiments, the attenuator is configured for separate attenuation on each sub-band signal of the received group of the first sub-band signals. A corresponding, individual attenuation is beneficial for a further increased attenuation or suppression of close talker interference.

In some embodiments, the correlator is configured to determine the at least one signal correlation repeatedly. For example, the correlator may be configured to determine the correlation continuously, e.g., using a 2-20 ms input block size.

In some embodiments, the correlator is configured to determine an (individual) signal correlation for each sub-band signal of the group of sub-band signals.

In some embodiments, the first filter bank and the second filter bank are configured so that at least each of the group of first sub-band signals has an associated sub-band signal in the group of second sub-band signals. In other words, for each sub-band signal in the group of the first sub-band signals, an associated sub-band signal in the group of second sub-band signals is given.

The present embodiments improve the comparability between the sub-band signals of the two groups and thus, the determination of the signal correlation. In some embodiments, the associated sub-band signals have an identical bandwidth and/or an identical frequency range.

As discussed in the preceding, the filter banks may provide any number of sub-band signals. Correspondingly and in some embodiments, the filter bank may be provided with configurable filter band edge frequencies, and hence, e.g., configurable sub-band signal bandwidths. For example and in case an FFT is conducted, the sub-band signal bandwidth may be selected as an integer of the respective FFT bin-width, e.g., with a 128 point FFT at 16 ksamples/sec, as a multiple of 125 Hz. In alternative embodiments, 64 or 256 point FFT may be conducted, resulting in 4 and 16 ms latency, respectively.

In some embodiments, the filter banks provide at least 2, 5, or 8 sub-band signals. In some embodiments, the filter banks provide at least 12 or 16 sub-band signals. In some embodiments, the filter banks provide a maximum of 20 sub-band signals. In some embodiments, the filter bank provides sub-band signals of a bandwidth of at least 250 Hz.

In some embodiments, the filter banks are configured to provide one or more of the sub-band signals to match psychoacoustic bands, i.e., as identified in the field of psychoacoustics to have an influence on noise perception. In these embodiments, at least some sub-band signals may be formed to correspond to the "critical bands" as defined in Psychoacoustics: Facts and Models: By Hugo Fastl, Eberhard Zwicker (Springer Verlag; 3rd edition (Dec. 28, 2006)).

In some embodiments, the correlator is configured, for each of the group of first sub-band signals, to determine a signal correlation between a sub-band signal of the group of first sub-band signals and the associated (e.g., identical) sub-band signal of the group of second sub-band signals.

In some embodiments, the attenuator is configured for each of the group of first sub-band signals to conduct signal attenuation based on the signal correlation of the respective first sub-band signal and the associated second sub-band signal.

The preceding embodiments provide a 'granular' approach to the determination of the signal correlation and the corresponding attenuation. In other words, an independent or separate signal correlation per sub-band signal is determined, which is then used for the attenuation of the respective same sub-band signal. The preceding embodiments result in a further improved attenuation of interfering talkers and noise.

In some embodiments, the attenuator is configured so that the signal attenuation is increased with a decrease in the at least one signal correlation. In case multiple signal correlations are determined, such as in the case of the above granular approach, the signal attenuation for a given sub-band signal of the first sub-band signals is increased when a decrease in the signal correlation between the given sub-band signal of the first sub-band signals and the associated sub-band signal of the second sub-band signals is determined.

In some embodiments, the audio device further comprises at least one average power detector, configured to determine an average power for each sub-band signal of the group of first sub-band signals and the group of second sub-band signals. The determination of the at least one average power detector may in some embodiments be continuous or at least repetitive. In some embodiments, the average power is calculated for each sub-band signal as an exponential average with two-sided smoothing.

In some embodiments, the correlator is connected with the at least one average power detector. The correlator may be configured to determine the at least one signal correlation from the determined average power for each sub-band signal of the group of first sub-band signals and the group of second sub-band signals.

In some embodiments, the attenuator is connected with the at least one average power detector and is configured so that the signal attenuation of a sub-band signal of the group of first sub-band signals is increased with an increase in average power on the associated sub-band signal of the group of second sub-band signals.

In some embodiments, the attenuator is additionally configured for gain smoothing, i.e., adapting gain settings for adjacent sub-bands. The present embodiment provides linear interpolation to smooth the gains of adjacent sub-bands to increase the quality of the voice output signal. It is noted that the term 'gain' herein is understood with its usual meaning in electronics, namely a measure of the ability of a circuit to increase the power or amplitude of a signal. A gain smaller than one means an attenuation of the signal.

In some embodiments, the audio device further comprises a silence detector connected with the attenuator, which silence detector is configured to control the attenuator when voice silence determined.

The present embodiments provide a further increased quality of the voice output signal. The silence detector may be configured to determine whether or not the user is talking. If the user should not be talking, i.e., the voice input signal comprises only background noise as well as close talker interference, referred herein as a state of "voice silence", the silence detector controls the attenuator, e.g., to provide a constant signal level and/or to prevent impulsive ambient noise or loud parts of unwanted speech from breaking through for example by controlling the expansion factor(s) or by controlling the attenuation of the attenuator.

The silence detector may be of any suitable type. For example, the silence detector may comprise a non-voice activity detector, as known in the art. In another example, the silence detector determines voice silence based on a determination of average power.

The silence detector in some embodiments may enhance the operation of the attenuator by temporarily controlling the sub-band attenuation to an elevated level, i.e., increased attenuation.

The present embodiments may provide that, when the ambient noise is loud, it does not get modulated by the attenuator, which would make it more noticeable and distracting.

In some embodiments, the silence detector is configured to determine voice silence when the average power for each sub-band signal of the group of first sub-band signals is below an average silence signal level for a predetermined time period or sample number, such as about 1000 samples, resulting in a predetermined time period of 62.5 ms.

In some embodiments, the silence detector is configured to set an attenuation level for each of the sub-band signals of the group of first sub-band signals to a common silence attenuation level when voice silence is determined. As will be apparent, the present embodiments provide that the attenuation level is commonly set for the group of first sub-band signals if voice silence is detected. In some embodiments, the attenuation level may be set relatively high, so that essentially all sub-band signals of the group of sub-band signals are attenuated. This is beneficial, as during voice signal silence, no user speech is present in the voice input signals.

For example, if voice silence is detected, the attenuation level is set to a common silence threshold, which common silence threshold is higher than an operating threshold, applied during normal operation, i.e., when the user is talking.

The evaluation of the average power detector by the silene detector may in some embodiments be continuous or at least repetitive. In some embodiments, the determination of average power is the power in a 4 ms FFT window or frame. It may be calculated in the frequency domain although it could also be calculated in the time domain as the two are equivalent as described in Parsevals theorem.

In some embodiments, the silence detector is configured to release control of the attenuator per sub-band in case the respective average power in a respective sub-band signal of the group of first sub-band signals exceeds the average silence signal level. In this case, the operation of the attenuator returns to its previous state using its previous settings.

In some embodiments, the silence detector may be configured so as to not release the control of the attenuation levels for sudden loud impulse noises, for example for noise emanating from a dropped item or person coughing.

In some embodiments, the silence detector is a speech-band level detector with a fast rise time and slow fall time. The fall time should be long enough that the silence detector does not trigger in the gaps between normal speech, typically 100-200 ms, and the rise time should be short enough that the beginning of an utterance is not cut off, typically 20-50 ms.

In some embodiments, the audio device further comprises a voice harmonics detector, connected and/or integrated with the attenuator. In some embodiments, the voice harmonics detector is configured to determine a fundamental sub-band signal from the group of first sub-band signals that comprises a fundamental voice component.

In this context, the term "fundamental voice component" is understood to comprise at least the fundamental frequency of the user's voice when speaking. In a typical scenario, the fundamental frequency of an adult male may be in the range of 85 Hz to 180 Hz, while the fundamental frequency of an adult female may be in the range of 165 Hz to 255 Hz.

In some embodiments, the voice harmonics detector is further configured to determine one or more harmonics sub-band signals from the group of first sub-band signals that comprise harmonics voice components of the fundamental voice component. In other words, the voice harmonics detector may be configured to determine one or more harmonics of the harmonic series of the user's voice. In some embodiments, the voice harmonics detector determines the next 4 harmonics and the associates sub-band signals.

In some embodiments, the voice harmonics detector is configured to control the attenuator so that the signal attenuation of the one or more harmonics sub-band signals correspond to the signal attenuation of the fundamental sub-band signal. This serves to "link" the attenuation in the fundamental sub-band signal to the attenuation in the one or more harmonics sub-band signals and thus further increases the quality of the voice output signal by preventing filtering of the wanted speech by the expander that would cause unnatural sound due to changes in the spectral balance of the voice.

In some embodiments and to speed up the opening of the attenuator at the onset of speech utterance, the attenuator is configured so that the maximum attenuation for each sub-band signal of the group of first sub-band signals is implemented so that it only provides to the attenuation necessary to prevent the transmission of unwanted speech. By limiting the maximum attenuation, there is less attenuation to remove once the speech utterance starts and so the opening of the attenuator is sped up and the change in gain is less noticeable. In this way, a gain change delta may be minimized and time reduced.

In some embodiments, the attenuator is user-configurable during operation. For example, two presets may be selectable, namely 'basic' and 'increased'. In some embodiments, the 'basic' preset provides a relatively mild or smooth attenuation. In some embodiments, the 'increased' preset provides a higher attenuation.

According to a further exemplary aspect, an audio processor for improved talker discrimination is provided. The audio processor is configured to receive a first voice input signal and a second voice input signal and the audio processor comprises at least a first filter bank, configured to provide a plurality of first sub-band signals from the voice input signal; a second filter bank, configured to provide a plurality of second sub-band signals from the second voice input signal; a correlator, configured to determine at least one signal correlation between at least a group of the first sub-band signals and at least a group of the second sub-band signals; and an attenuator, arranged to receive at least the group of the first sub-band signals and configured to conduct signal attenuation on the group of the first sub-band signals to provide gain-controlled sub-band signals, wherein the signal attenuation is based on the determined at least one signal correlation.

The audio processor of this aspect may be of any suitable type and may comprise hard-wired circuitry and/or programming for providing the described functionality. For example, the audio processor may be a digital signal processor (DSP) such as those currently available on the market or a custom analog integrated circuit such as an Application Specific Integrated Circuit (ASIC).

The audio processor according to the present exemplary aspect and in further embodiments may be configured according to one or more of the embodiments, discussed in the preceding with reference to the preceding aspect. With respect to the terms used for the description of the present aspect and their definitions, reference is made to the discussion of the preceding aspect.

According to another exemplary aspect, a method of audio processing for improved talker discrimination is provided. The method comprises at least providing a plurality of first sub-band signals from a first voice input signal; providing a plurality of second sub-band signals from a second voice input signal; determining at least one signal correlation between a group of the first sub-band signals and a group of second sub-band signals; and conducting signal attenuation on the group of first sub-band signals to provide gain-controlled sub-band signals, wherein the signal attenuation is based on the determined signal correlation.

The method according to the present exemplary aspect in further embodiments may be configured according to one or more of the embodiments, discussed in the preceding with reference to the preceding aspects. With respect to the terms used for the description of the present aspect and their definitions, reference is made to the discussion of the preceding aspects.

The systems and methods described herein may in some embodiments apply to narrowband (8 kS/s) and/or wideband (16 kS/s) and/or superwideband (24/32/48 kS/s) implementations. The systems and methods described herein in some embodiments may provide adjustable filter band edge frequencies (and hence bandwidths). The systems and methods described herein may in some embodiments provide adjustable thresholds, attack & release time constants, and/or expansion ratios for each band. The systems and methods described herein may in some embodiments provide an attenuator (gain control) block that may be used on its own. The systems and methods described herein may achieve a latency of less than 6 ms.

Reference will now be made to the drawings in which the various elements of embodiments will be given numerical designations and in which further embodiments will be discussed.

Specific references to components, process steps, and other elements are not intended to be limiting. Further, it is understood that like parts bear the same or similar reference numerals when referring to alternate figures. It is further noted that the figures are schematic and provided for guidance to the skilled reader and are not necessarily drawn to scale. Rather, the various drawing scales, aspect ratios, and numbers of components shown in the figures may be purposely distorted to make certain features or relationships easier to understand.

FIG. 1 shows an embodiment of an audio device with improved talker discrimination, namely of a headset 1. The headset 1 comprises two earphones 2*a*, 2*b* with speakers 6*a*, 6*b*. The two earphone housings 2*a*, 2*b* are connected with each other over headband 3. A primary microphone 5*a* is arranged on microphone boom 4. A secondary microphone 5*b* is arranged as a part of the earphone housing 2*b*.

The headset 1 is intended for wireless telecommunication and is connectable to a host device, such as a mobile phone, desktop phone communications hub, computer, etc., over a cable, Bluetooth, DECT, or other wired or wireless connection.

Figure 2:
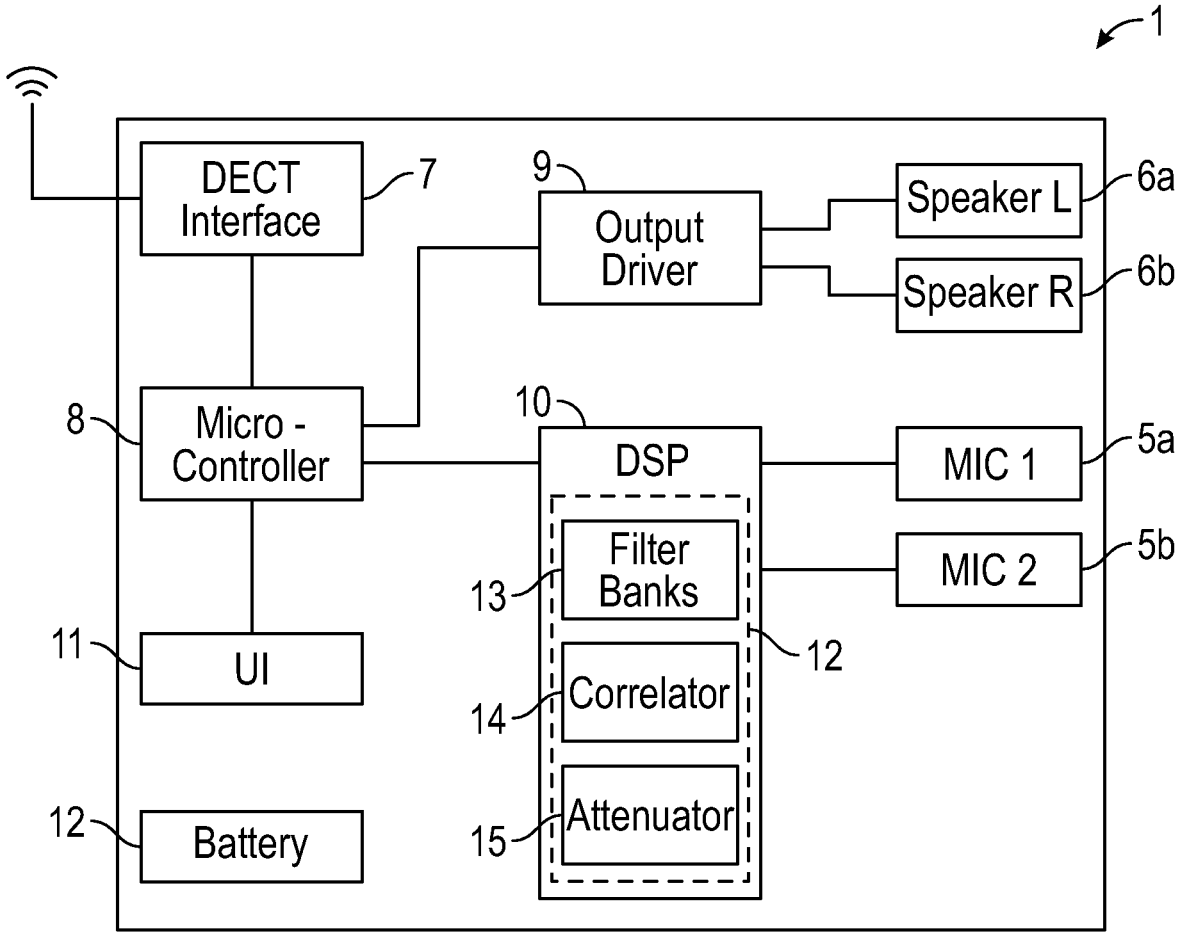
FIG. 2 shows a schematic block diagram of the headset according to the embodiment of FIG. 1.

FIG. 2 shows a schematic block diagram of the headset 1 according to the embodiment of FIG. 1 implemented as a DECT wireless headset. Besides the already mentioned speakers 6*a*, 6*b* and the microphone 5, the headset 1 comprises a DECT interface 7 for connection with the aforementioned host device. A microcontroller 8 is provided to control the connection with the host device. Incoming audio, received via the host device is provided to output driver circuitry 9, which comprises a D/A converter, and an amplifier. Audio, captured by the primary and secondary microphones 5*a* and 5*b*, herein referred to as the first voice input signal and the second voice input signal, respectively, is processed by a digital signal processor (DSP) 10, as will be discussed in further detail in the following. A voice output signal is provided by the DSP 10 to the microcontroller 8 for transmission to the host device.

In addition to the above components, a user interface 11 allows the user to adjust settings of the headset 1, such as ON/OFF state, volume, etc. Battery 12 supplies operating power to all of the aforementioned components. It is noted that no connections from and to the battery 12 are shown so as to not obscure the FIG. All of the aforementioned components are provided in the earphone housings 2*a*, 2*b*.

As discussed in the preceding, headset 1 is configured for improved talker discrimination. In the present context, the improved talker discrimination is primarily provided by the arrangement of the primary microphone 5*a* and the secondary microphone 5*b*, as well as by the processing of DSP 10, which receives the first and second voice input signals from microphones 5*a* and 5*b* and provides a processed voice output signal that exhibits improved talker discrimination.

Improved talker discrimination in the context of this embodiment means that a (far-end) communication participant, receiving the (near-end) recorded voice of the user of headset 1, can more easily understand the voice of the user, even in the case of other talkers close by, such as in a call center environment.

As will be apparent from FIG. 2, DSP 10 comprises a talker discrimination processing circuit 12. The circuit 12 may be provided using hard-wired circuitry, programming/software running on DSP 10, or a combination thereof. Main components of talker discrimination processing circuit 12 are two filter banks 13, a correlator 14, and an attenuator 15. Other components may optionally be present as a part of the DSP 10 or the talker discrimination processing circuit 12. Some embodiments of such components are discussed in the following.

The filter banks 13 provides a plurality of first sub-band signals from the first voice input signal and a plurality of second sub-band signals from the second voice input signal. Correlator 14 receives at least a group/subset of the first sub-band signals as well as a group/subset of the second sub-band signals. Correlator 14 quasi-continuously (using a 4 ms or 8 ms window size) determines a spectral density correlation between each of the group of first sub-band signals and the associated sub-band signal from the group of second sub-band signals. Attenuator 15 processes the subset of first sub-band signals and attenuates according to the determined spectral density correlation of the respective sub-band signal.

One underlying idea of this setup is that by splitting the microphone voice input signals of both microphones into several frequency bands and performing individual attenuation on these bands based on the respective spectral density correlation of each sub-band, it is possible to efficiently attenuate the bands that comprise noise or interfering close talkers, even when the headset user is talking. In other words, the audio is separated into several frequency bands to facilitate attenuation only in the correct bands. This separation allows to attenuate the bands comprised of unwanted audio, such as noise or interfering close talkers, whilst passing the bands comprised predominately of the user's speech.

By using a primary and secondary microphone, it is possible to distinguish between the primary (boom) microphone signal and ambient noises, including other talkers, based on at least the correlation between the two microphone signals as well as the relative amplitude difference between the signals. The laws of acoustics define the relative difference in amplitude between the two microphones. When only the headset user is talking, there is strong coherence between the two microphone signals. When there is another talker and/or noise, the coherence decreases. The headset user maintains a fixed position of the two microphones on her or his head relative to her or his mouth, which produces a well-defined amplitude relationship between the first and second voice input signals. Conversely, interfering sounds other than the headset user's voice fall outside both of these relationships. Using these criteria, the headset user's voice can be efficiently identified and separated.

User speech on the primary microphone 5*a* may provide (per sub-band): a) a larger average power compared to the secondary microphone 5*b* and *b*) a high coherence between primary 5*a* and secondary microphone 5*b*.

Ambient noise when the user is not speaking may provide (per sub-band): a) the secondary microphone 5*b* having a larger average power than primary microphone 5*a* and *b*) a low coherence between the microphones 5*a*, 5*b*.

When both, user speech and noise are present, the relative amplitude differences and strength of the coherence are used to modulate the amount of attenuation applied on a per sub-band basis.

Figure 3:
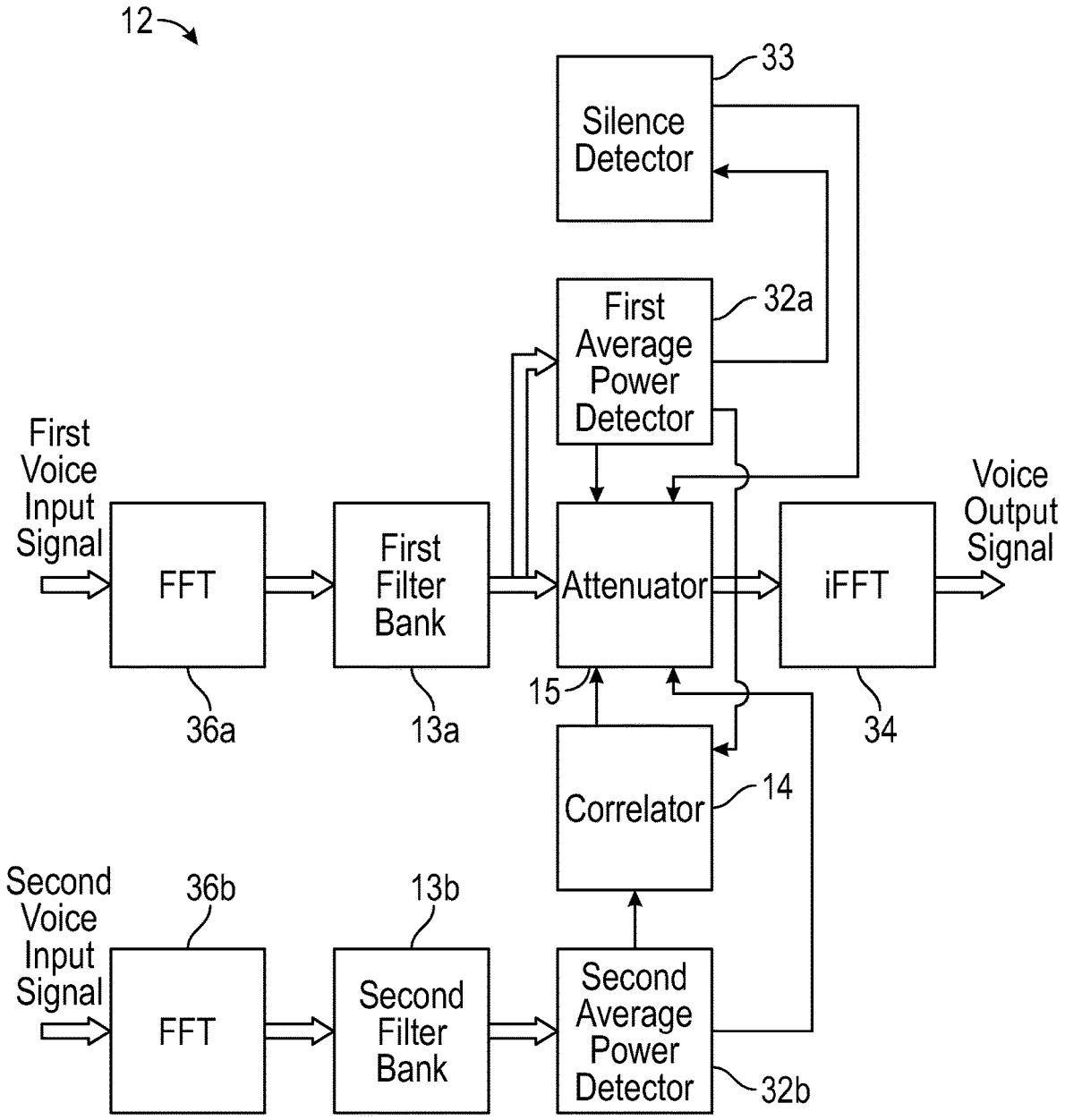
FIG. 3 shows a schematic block diagram of a talker discrimination processing circuit for use in the embodiment of FIGS. 1 and 2.

FIG. 3 shows a schematic block diagram of talker discrimination processing circuit 12. The first and second voice input signals, as received from microphones with or without intermediate processing, are provided to respective FFT (Fast Fourier Transform) circuits 36*a* and 36*b*, which sample the voice input signals over time and divide them into their frequency components. It is noted that the further processing is conducted in the frequency domain until the voice output signal is being converted back to the time domain by synthesis filter bank 34, performing inverse Fourier transform to provide a time-domain voice output signal.

The filter banks 13*a* and 13*b* each provides a number of sub-band signals from the voice input signals corresponding to an integer number of FFT bins. For example, a 128-point FFT at 16 k samples/sec has an FFT bin-width of 16000/128=125 Hz. The minimum bandwidth of a sub-band signal thus is 125 Hz. Other possible widths would be 62.5 Hz, 250 Hz, 325 Hz, etc., i.e., any width constructible from an integer number of FFT bins. The sub-band setup, i.e., the number of overall FFT bins/sub-band signals, can be tuned either to save cycles, or to improve audio quality. The impact on quality may be subtle. It is noted that a given sub-band signal may include one or more FFT bins. In other words, the sub-band signals may span over a single or a plurality of FFT bins, depending on the application.

The number and bandwidths of the sub-bands may be modified, e.g., using the user interface 11. For reasons of clarity, connections for parameter control are not shown in FIG. 3.

In this embodiment, a group of 16 first sub-band signals are generated from the FFT-converted first voice input signal and a group of 16 first sub-band signals are generated from the FFT-converted second voice input signal. The configuration of the group of first sub-band signals matches the configuration of the group of second sub-band signals, i.e., the number, bandwidth, start and end frequencies (frequency range) between the first and second sub-band signals are identical. Accordingly, for each of the first sub-band signals, there is an associated matching second sub-band signal. The frequency bands are configured to correspond to the "critical bands" as defined in Psychoacoustics: Facts and Models: By Hugo Fastl, Eberhard Zwicker (Springer Verlag; 3rd edition (Dec. 28, 2006)). Table 1 below provides one exemplary embodiment of 16 bins, i.e., sub-band signals, and the corresponding frequency range. The table is stored in memory (not shown) of DSP 10 and thus is configurable in dependence of the application.

TABLE 1

| Bin edge | Frequency Range | |
|---|---|---|
| 2 | 0 | 250 |
| 4 | 251 | 500 |
| 6 | 501 | 750 |
| 8 | 751 | 1000 |
| 10 | 1001 | 1250 |
| 12 | 1251 | 1500 |
| 14 | 1501 | 1750 |
| 16 | 1751 | 2000 |
| 19 | 2001 | 2375 |
| 24 | 2376 | 3000 |
| 30 | 3001 | 3750 |
| 37 | 3751 | 4625 |
| 46 | 4626 | 5750 |

TABLE 1-continued

| Bin edge | Frequency Range | |
|---|---|---|
| 51 | 5751 | 6375 |
| 58 | 6376 | 7250 |
| 65 | 7251 | 8125 |

The most critical frequency range for speech in a narrowband audio application is defined from 300 Hz to 3 kHz. In the present embodiment, a wideband audio application is discussed and the critical frequency range extends from 300 Hz up to 8 kHz.

The group of first sub-band signals are passed from the filter bank 13*a* to a first average power detector 32*a* and to the attenuator 15. The group of second sub-band signals are passed from the filter bank 13*b* to the second average power detector 32*b*. It is noted that in this embodiment, the entire groups of sub-band signals are subjected to the discussed processing. However, it is possible that some sub-band signals are not processed in some embodiments. In this case the respective unprocessed sub-band signals of the first voice input signals are passed through to the synthesis filter bank 34 without processing by attenuator 15.

The first average power detector 32*a* determines an average power in each of the group of first sub-band signals. The corresponding average power values are used by the correlator 14, the attenuator 15, and the silence detector 33. The second average power detector 32*b* determines an average power in each of the group of second sub-band signals. The corresponding average power values of the group of second sub-band signals are used by the correlator 14 and the attenuator 15.

The average power detectors 32*a* and 32*b* use an exponential averaging and 2-sided smoothing. Attack and release parameters may be programmable. For example, 10 ms attack time and 15 ms release time may be used to balance fast response time of the expanders and silence detector with the dynamics of speech.

The correlator 14 is configured to determine a spectral density correlation on a per sub-band signal basis between each of the first sub-band signals and the associated sub-band signal of the second sub-band signals. The correlator 14 in this embodiment is configured to determine the spectral density correlation using the average 'per sub-band' power, determined by the first average power detector 32*a* and the second average power detector 32*b*. This is to provide a measure of time-frequency correlation as input to the attenuator 15. The spectral density correlation $C_{xy}(f)$ for each of the sub-bands are calculated as follows:

$$C_{xy}(f) = \frac{|G_{xy}(f)^2|}{G_{xx}(f)G_{yy}(f)}$$

where x denotes the average power of a first sub-band signal, y denotes the average power of the associated second-sub-band signal, $G_{xy}$ denotes the cross-spectral density (e.g., a cross correlation), and $G_{xx}$ and $G_{yy}$ denote the auto-spectral densities of the two sub-band signals. It is noted that the correlator 14, instead of using the average 'per sub-band power', could be configured to determine the correlation between the sub-band signals themselves. In this case, the first and second filter bands 13*a* would provide the group of first sub-band signals and the group of second sub-band signals to the correlator 14. The attenuator 15 is configured to independently attenuate each sub-band signal of the group of first sub-band signals based on the respective correlation of that sub-band signal and the average power difference between the respective first sub-band signal and the associated second sub-band signal.

The attenuator 15 continuously (e.g., for every 4 ms or 8 ms FFT block) compares the associated sub-bands of the group of first sub-band signals and the group of second sub-band signals. The attenuator 15 in this exemplary embodiment does not provide a binary decision, e.g., 'distractor present' or 'distractor absent'; rather a continuous estimate how much distractor (or noise) is present. Instead, the attenuator 15 applies the following rules:

1) When the respective first sub-band signal and the associated second sub-band signal are highly correlated and the first sub-band signal has more power than the second sub-band signal, the attenuator 15 concludes primary speech and no attenuation is applied to this sub-band signal. If there is also ambient noise, it will attenuate gently to remove that.

2) When there is more power on the first sub-band signal compared to the second sub-band signal and a lower correlation between them, the attenuator 15 concludes an interfering talker is present or very high ambient noise is given. Then, a modest attenuation is provided in proportion to the low correlation. Again, this attenuation is applied per sub-band and impacts only the respective sub-band(s) with poor correlation.

3) When the second sub-band signal contains more power than the first sub-band signal, the attenuator 15 concludes there is only distractor speech and attenuates the respective sub-band signal aggressively according to a respective maximum attenuation setting, balancing the degree to which unwanted sounds are attenuated with a desired audio quality, for example >=12 dB.

In this way, an array of "confidence factors" for the presence of wanted speech in each sub-band is calculated and this array is then used to calculate the attenuation (or gain) to be applied. A single multiplication factor or "amnr gain" may be applied to control the degree to which unwanted sounds are attenuated. Certainly, a higher degree of attenuation usually does along with a decreased audio quality.

The operation of attenuator 15 can be summarized in one example as follows:

$$\text{amnr_atten} = \frac{mic1[i] - amnr_{gain} * \text{MIN}(mic1, mic2[i] * C_{xy}(f))}{mic1[i]},$$

wherein 'amnr_atten' is the per sub-band attenuation factor, applied by attenuator 15 to the respective sub-band, 'amnr_gain' is the multiplier factor, discussed in the preceding, mic1[i] and mic2[i] are the per sub-band "average power" values for the primary 5*a* and secondary 5*b* microphones, respectively, $C_{xy}$(f) is the spectral density correlation, discussed in the preceding, and 'MIN(a,b)' refers to the minimum value.

In addition, the attenuator 15 comprises configurable attack and release parameters, which are time constants and may be, for example, 4 ms attack and 50 ms release. In this embodiment, the attenuator 15 uses 2-sided exponential time-smoothing.

The resulting gain changes in each of the sub-bands, are "smoothed" by these attack and release time constants to prevent the generation of artifacts such as clicks and pops and defined by the well-known exponential response equation A=A0*e^(−t/tau) where tau is the time constant.

Silence detector 33 is used to determine voice silence, i.e., a state where the headset user is not speaking. The first voice input signal in this state comprises just background noise including close talker interference, which may comprise impulsive noise, disturbing to the receiving party. In such a scenario, impulsive ambient noise could open up the attenuator 15 causing a noise burst to be transmitted. The silence detector 33 in essence exploits the difference between the impulsive nature of noises such as items being dropped, people coughing or sneezing, ringtones, and other machine notification tones and the relatively slow envelope of speech. The silence detector allows the attenuator 15 to ignore sudden or impulse sounds and to freeze the attenuator 15 until the next speech envelope is detected.

Figure 4:
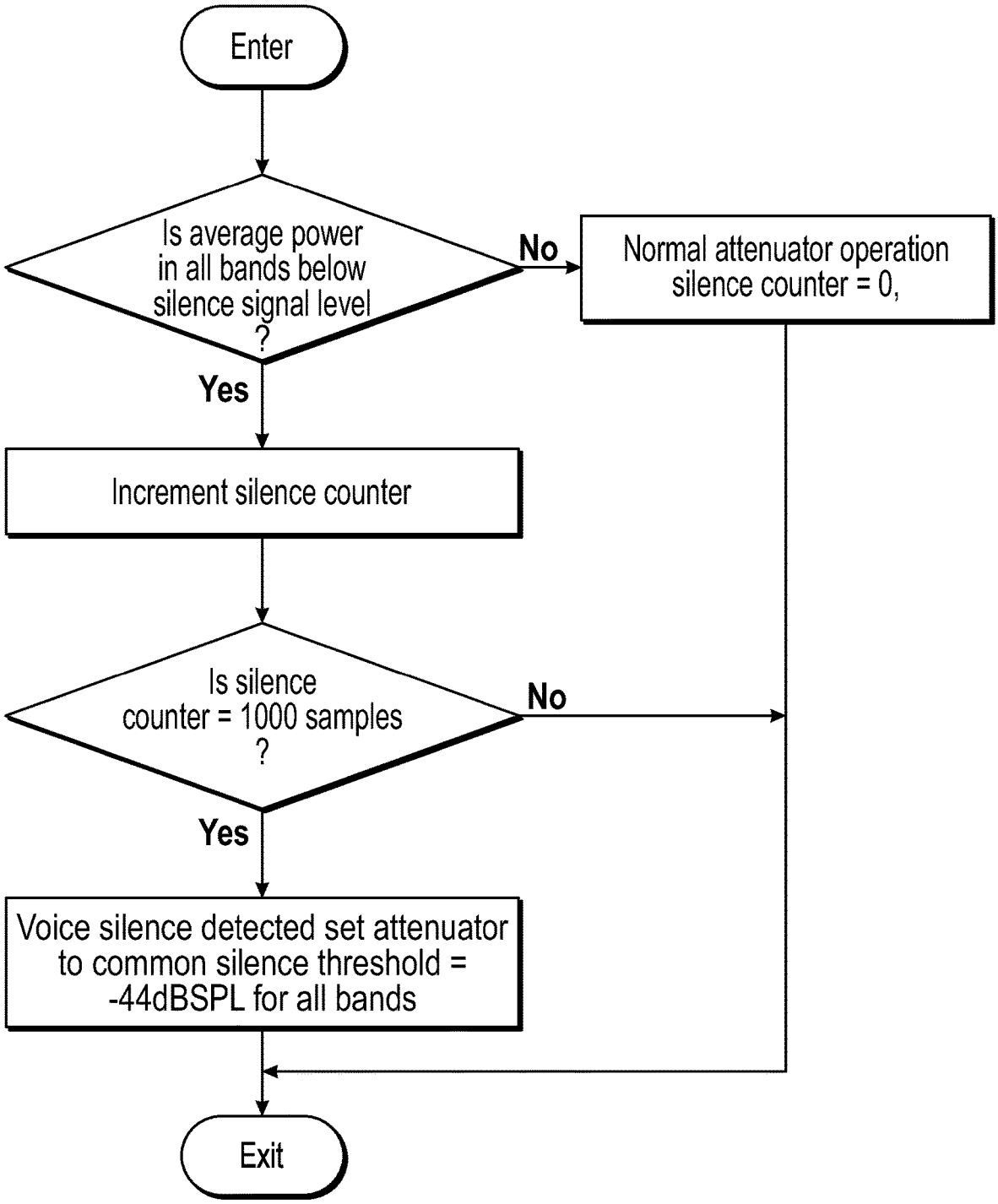
FIG. 4 shows a flow-chart of the operation of a silence detector.

More precisely, the silence detector 33 detects "voice silence" when the average power in all sub-band signals is beneath a configurable silence signal level, i.e. a threshold, for 1000 FFT samples, i.e., 62.5 ms. When this happens, the silence detector 33 controls the attenuator 15 to a common silence threshold, so that an aggressive attenuation (20 dB) of all sub-band signals is provided. In particular, it is noted that during this state, all sub-band signals are equally attenuated by the common silence threshold. FIG. 4 shows a flow-chart of the operation of the silence detector 33.

The attenuator 15 stays in the voice silence state with aggressive attenuation until the average power in the respective sub-band indicates that user speech is present. Then, the attenuator 15 is controlled by the silence detector 33 to return to normal operation. In this way, the response time, to "wake up" from a silence period is still very fast.

After the processing of the attenuator 15, the synthesis filter 34 combines the sub-band signals and converts back to the time domain. The voice output signal may then be subjected to further processing or provided directly to the far-end communication participant.

To improve the operation of the attenuator 15 further, an optional frequency smoothing algorithm may be applied to the sub-band signals in addition to the time-smoothing via the attack and release parameters. This may include a linear-interpolation applied to smooth the expansion factors between adjacent sub-bands, which may improve audio quality. As an option, turning off smoothing, or using a simplified smoothing, may save resources, such as cycles and/or power.

To speed up the opening of the attenuator 15 at the onset of speech utterance, a maximum attenuation for each sub-band may be implemented so that only the attenuation necessary is applied to prevent the transmission of unwanted speech. In this way, a gain change delta may be minimized and the control of the expanders expedited.

Figure 5:
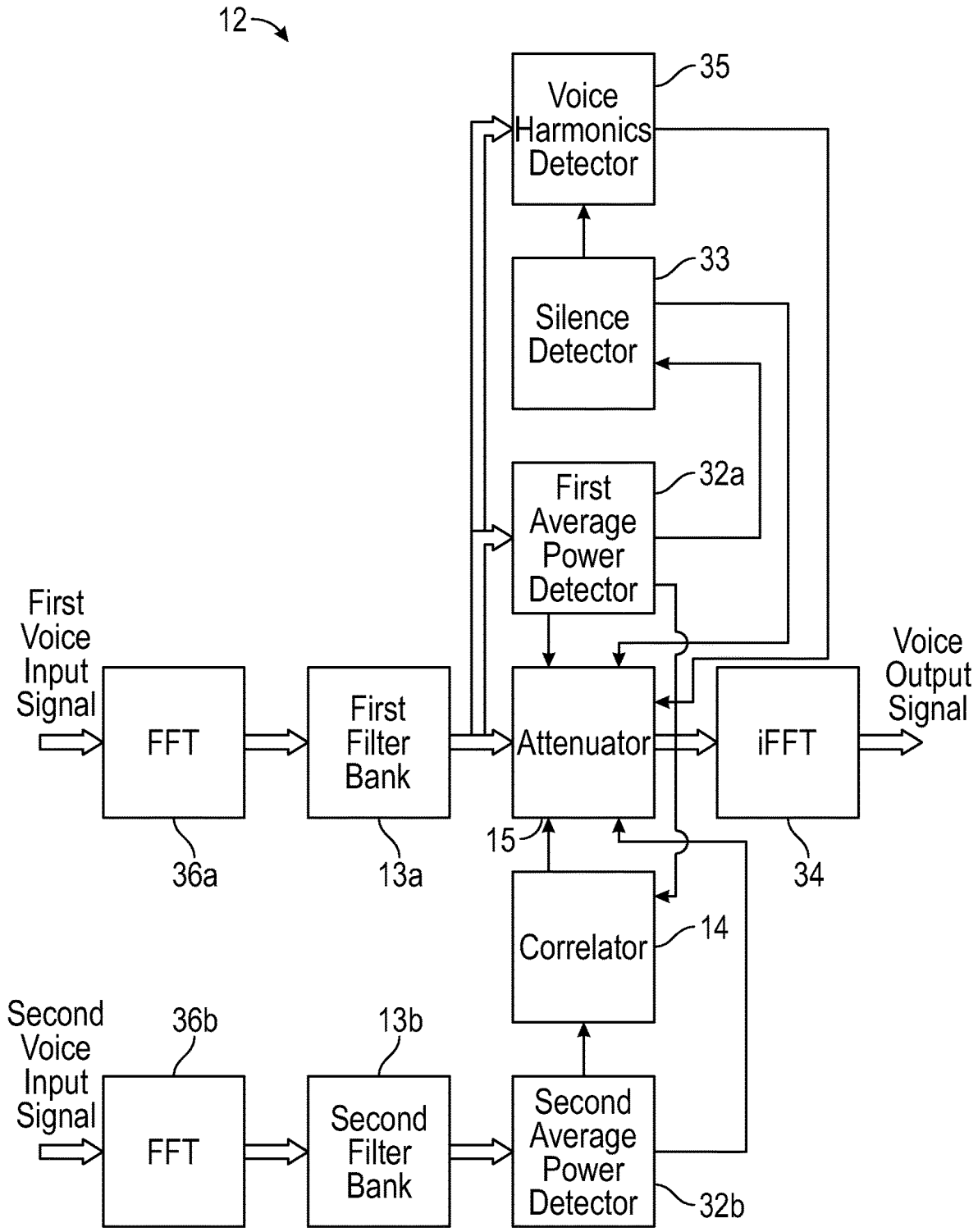
FIG. 5 shows another schematic block diagram of a talker discrimination processing circuit having a voice harmonics detector.

FIG. 5 shows another embodiment of talker discrimination processing circuit 12*a*. The circuit corresponds to the talker discrimination processing circuit 12 of FIG. 3 with the exception that DSP 10 additionally comprises a voice harmonics detector 35 that is arranged to receive the group of first sub-band signals from the first filter bank 13*a* and that is configured to control the attenuator 15.

The operation of the voice harmonics detector 35 is based on the fact that all voices have many harmonics that are related to a fundamental by a simple integer factor. By identifying the lowest frequency bin with speech energy in it, the harmonic bins related to the fundamental may be dynamically linked and the attenuation provided may move in step, thereby eliminating an unequal attenuation of voiced harmonics characterizing a particular person's voice.

Accordingly, the voice harmonics detector 35 is configured to determine a sub-band signal from the group of first sub-band signals comprising the fundamental frequency of the headset user's voice, determine the sub-band signals, comprising a number of harmonics of the user's voice, and control the attenuator 15 so that attenuation of the determined sub-band signals comprising the fundamental and the harmonics frequencies match each other. In other words, voice harmonics detector 35 serves to link the attenuation in the fundamental sub-band signal to the attenuation in the harmonics sub-band signals.

As will be apparent the number of harmonics that the voice harmonics detector 35 searches for may be configurable depending on the application, e.g., considering the available processing power of DSP 10, battery consumption, etc.

Figure 6:
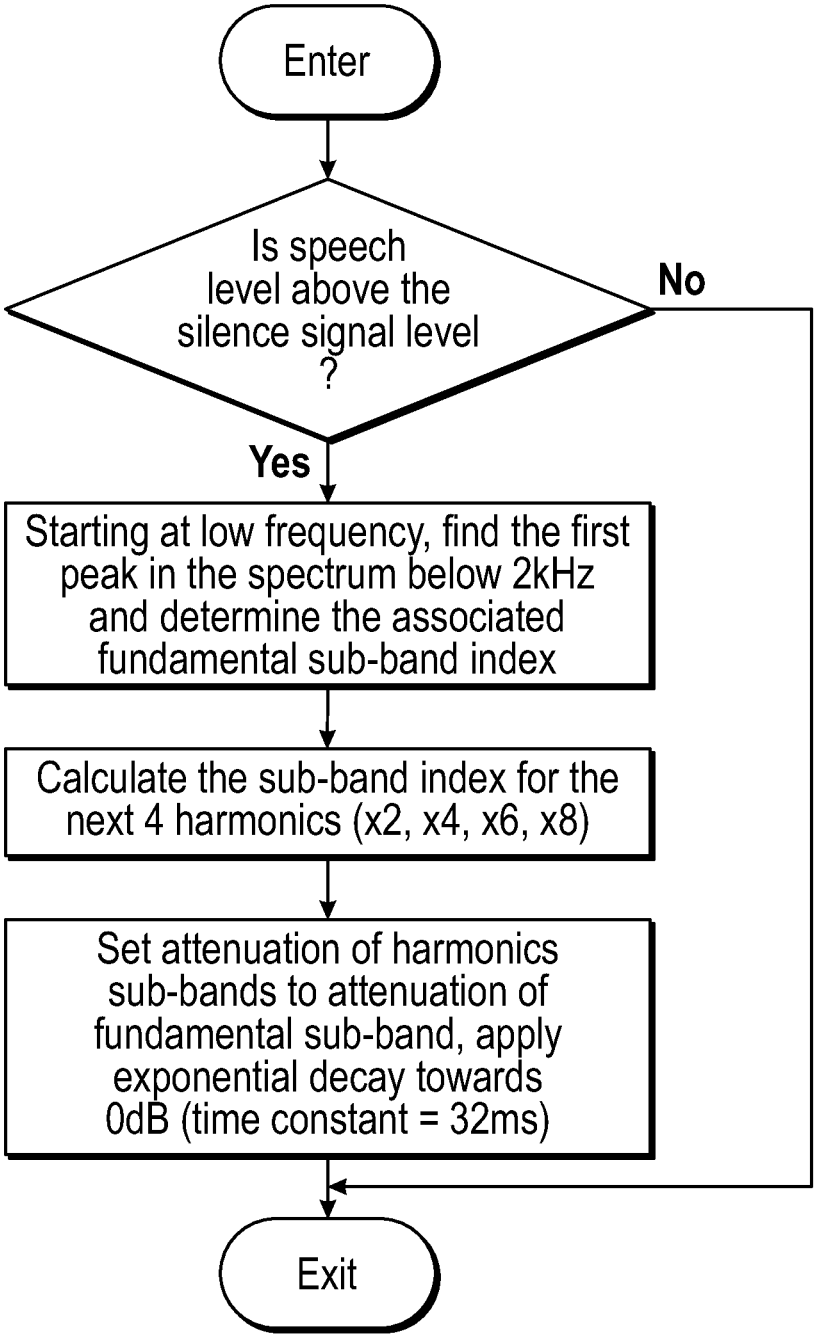
FIG. 6 shows a flow-chart of the operation of the voice harmonics detector of FIG. 5.

FIG. 6 is a flow chart illustrating the operation of the voice harmonics detector 35. The linking of the attenuation to stabilize speech audio quality may be performed in lieu of or in addition to adjacent band linking, described in the preceding.

The systems and methods described herein will prove critical for call centers and headset users dealing with private information, such as medical and financial records.

While the invention has been illustrated and described in detail in the drawings and foregoing description, such illustration and description are to be considered illustrative or exemplary, but not restrictive; the invention is not limited to the disclosed embodiments. For example, it is possible to operate the invention in any of the preceding embodiments, wherein instead of the audio device being provided as a headset, the audio device being formed as a body-worn or head-worn audio device such as smart glasses, a cap, a hat, a helmet, or any other type of head-worn device or clothing;

the output driver 9 comprises noise cancellation circuitry for the speakers 6*a*, 6*b*; and/or instead of or in addition to DECT interface 7, one or more of a Bluetooth interface, a WiFi interface, a cable interface, a QD (quick disconnect) interface, a USB interface, an Ethernet interface, or any other type of wireless or wired interface is provided;

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module, or other unit may fulfill the functions of several items recited in the claims.

The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

What is claimed is:

1. An audio device with improved talker discrimination, the audio device comprising at least a first audio input to receive a first voice input signal;

a second audio input to receive a second voice input signal;

a first filter bank circuit, configured to provide a plurality of first sub-band signals from the first voice input signal;

a second filter bank circuit, configured to provide a plurality of second sub-band signals from the second voice input signal;

a correlator circuit, configured to determine at least one signal correlation between at least a group of the first sub-band signals and at least a group of the second sub-band signals;

an attenuator circuit, arranged to receive at least the group of the first sub-band signals and configured to conduct signal attenuation on the group of the first sub-band signals to provide gain-controlled sub-band signals, wherein the signal attenuation is based on the determined at least one signal correlation and corresponds to a normal operation threshold;

an audio output circuit, configured to provide a voice output signal from at least the gain-controlled sub-band signals; and a silence detector circuit connected with the attenuator circuit, which silence detector circuit is configured to control the attenuator circuit and set the signal attenuation to a common silence threshold that is higher than the normal operation threshold when voice silence is determined.

2. The audio device of claim 1, wherein the correlator circuit is configured to determine the at least one signal correlation repeatedly.

3. The audio device of claim 1, wherein the correlator circuit is configured to determine multiple signal correlations.

4. The audio device of claim 1, wherein the first filter bank circuit and the second filter bank circuit are configured so that at least each of the group of first sub-band signals has an associated sub-band signal in the group of the second sub-band signals.

5. The audio device of claim 4, wherein for each of the group of first sub-band signals, the correlator circuit is configured to determine a correlation between a sub-band signal of the first sub-band signals and the associated sub-band signal of the second sub-band signals.

6. The audio device of claim 5, wherein the attenuator circuit is configured for each of the group of first sub-band signals to conduct signal attenuation based on the correlation between the respective sub-band signal of the first sub-band signals and the associated sub-band signal of the second sub-band signals.

7. The audio device of claim 1, wherein the signal correlation correspond to a spectral density correlation.

8. The audio device of claim 1, wherein the attenuator circuit is configured so that the signal attenuation is increased with a decrease in the signal correlation.

9. The audio device of claim 1, wherein the first and second filter bank circuits each provide at least eight sub-band signals and wherein the attenuator circuit conducts signal attenuation on the at least eight sub-band signals.

10. The audio device of claim 1, wherein the first and second filter bank circuits are configured to provide one or more of the sub-band signals to match psychoacoustic bands.

11. The audio device of claim 1, further comprising at least one average power detector circuit, connected to the attenuator circuit, the average power detector circuit being configured to determine an average power for each sub-band signal of the group of first sub-band signals and the group of second sub-band signals.

12. The audio device of claim 11, wherein the correlator circuit is connected with the at least one average power detector circuit, and wherein the correlator circuit is configured to determine the at least one signal correlation from the determined average power for each sub-band signal of the group of first sub-band signals and the group of second sub-band signals.

13. The audio device of claim 11, wherein the attenuator circuit is connected with the at least one average power detector circuit and is configured so that the signal attenuation of a sub-band signal of the group of first sub-band signals is increased with an increase in average power on the associated sub-band signal of the group of second sub-band signals.

14. The audio device of claim 1, wherein the first audio input comprises or is connectable to at least one primary microphone and the second audio input comprises or is connectable to at least one secondary microphone.

15. The audio device of claim 1, wherein the audio device is one or more of a communication audio device and a headset.

16. The audio device of claim 11, wherein the silence detector circuit is connected with the at least one average power detector circuit and wherein the silence detector circuit is configured to determine voice silence when the average power for each sub-band signal of the group of first sub-band signals is below an average silence signal level.

17. The audio device of claim 16, wherein the silence detector circuit is configured to release control of the attenuator circuit when the average power in a given sub-band signal of the group of first sub-band signals exceeds the average silence signal level.

18. A method of audio processing for improved talker discrimination, the method comprising providing a plurality of first sub-band signals from a first voice input signal;

providing a plurality of second sub-band signals from a second voice input signal;

determining at least one signal correlation between a group of the first sub-band signals and a group of second sub-band signals;

conducting signal attenuation on the group of first sub-band signals to provide gain-controlled sub-band signals, wherein the signal attenuation is based on the determined signal correlation and corresponds to a normal operation threshold;

detecting voice silence from the first voice input signal; and setting the signal attenuation to a common silence threshold that is higher than the normal operation threshold.

19. A non-transitory computer-readable medium including contents that are configured to cause a processing device to conduct the method of claim 18.

* * * * *